US005348219A

United States Patent [19]

Brintazzoli

[11] Patent Number: 5,348,219

[45] Date of Patent: Sep. 20, 1994

[54] BOX WITH A SEALED CLOSURE AND WITH A RECLOSABLE PRODUCT DELIVERY SPOUT

[75] Inventor: Renato Brintazzoli, Pianoro, Italy

[73] Assignee: O.A.M. S.p.a., Rastignano, Italy

[21] Appl. No.: 121,286

[22] Filed: Sep. 14, 1993

[30] Foreign Application Priority Data

Sep. 25, 1992 [IT] Italy ..... B092A000330

[51] Int. Cl.[5] ..... B65D 5/08

[52] U.S. Cl. ..... 229/131.1; 229/122; 206/497

[58] Field of Search ..... 229/131.1, 149, 151, 229/122; 206/497

[56] References Cited

U.S. PATENT DOCUMENTS

| | | | |
|---|---|---|---|
| 1,277,833 | 9/1918 | Beckwith | 229/131.1 |
| 1,432,932 | 10/1922 | Weis | 229/131.1 |
| 2,445,001 | 7/1948 | Pence | 229/131.1 X |
| 3,148,823 | 9/1964 | Diez | 229/149 X |
| 3,226,005 | 12/1965 | Paige | 229/149 |
| 3,269,635 | 8/1966 | Bergstein et al. | 229/131.1 X |
| 3,456,780 | 7/1969 | Forman | 206/497 |
| 4,094,456 | 6/1978 | Roccaforte | 229/131.1 |
| 5,190,200 | 3/1993 | Hammerlund | 229/149 X |

*Primary Examiner*—Allan N. Shoap
*Assistant Examiner*—Christopher McDonald
*Attorney, Agent, or Firm*—McAulay Fisher Nissen Goldberg & Kiel

[57] ABSTRACT

A box with a sealed closure guaranteeing the product contained therein, and with a reclosable product delivery spout, that comprises a box-like body with a product delivery spout, and a sliding plate hinged to the box-like body so that the plate faces, covers or reveals the spout being outside the box-like body and is shiftable towards two prefixed configurations, namely a first configuration, that is a non-use configuration, where the plate covers the product delivery spout while defining a sealed closure guaranteeing the product contained in the box, and a second configuration, that is a in-use configuration, where the plate, or a part thereof, is inserted into a slit made in the box-like body, thus defining a guide for the sliding of the plate upon the outer surface of the box-like body along a stroke so limited as to cover or to reveal the product delivery spout.

13 Claims, 3 Drawing Sheets

FIG. 1
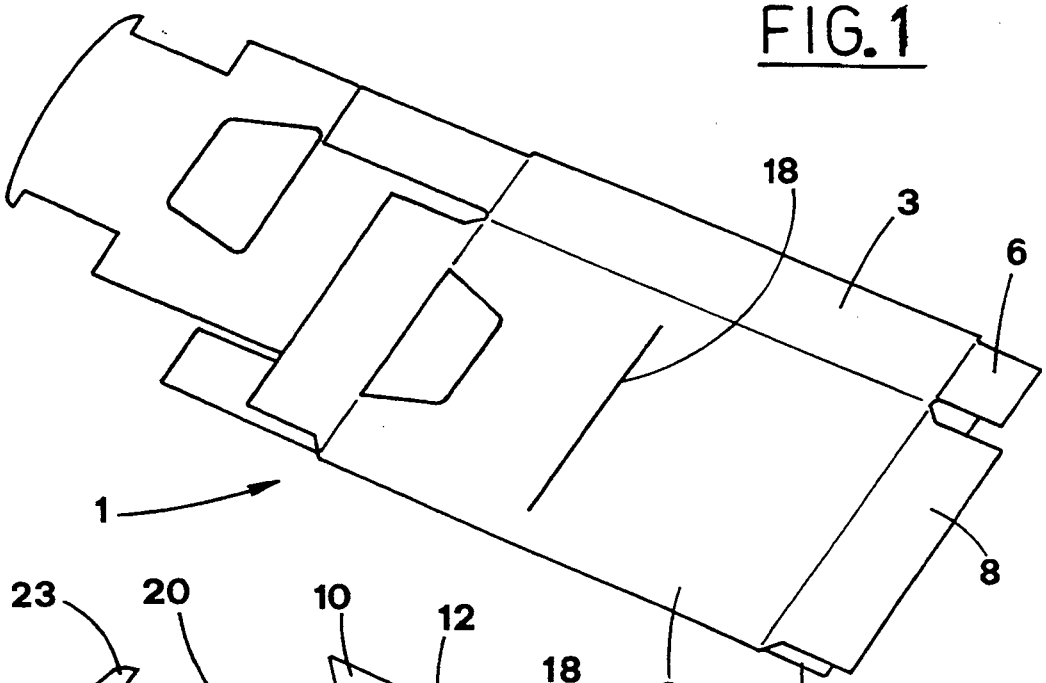
FIG. 2
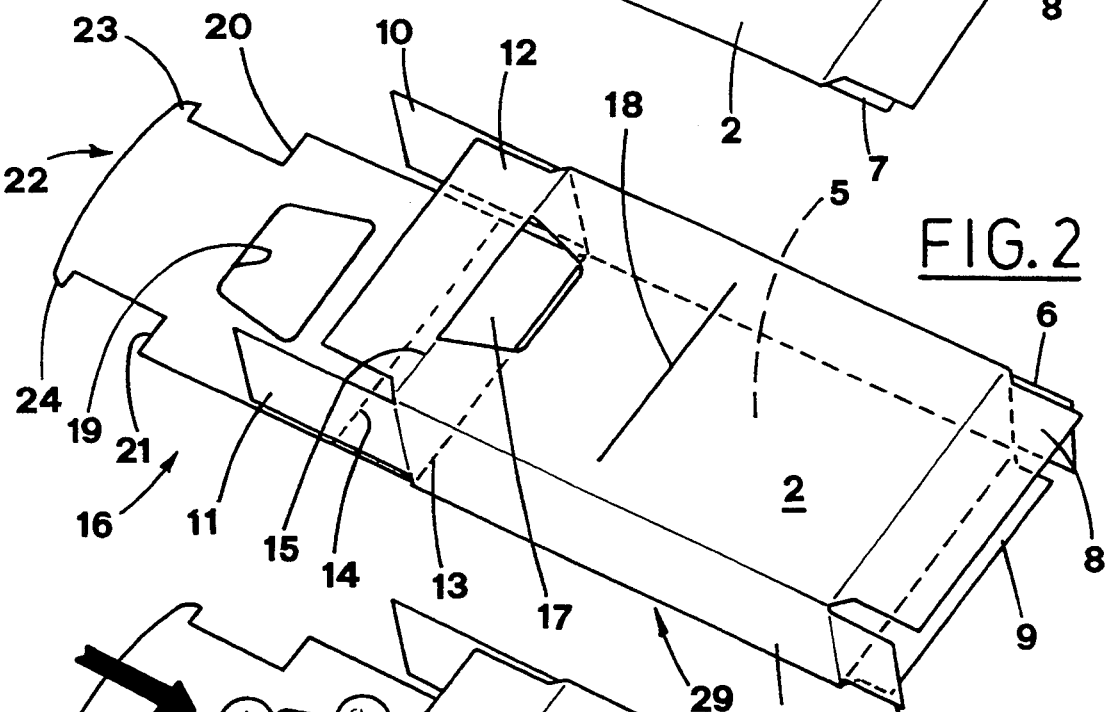
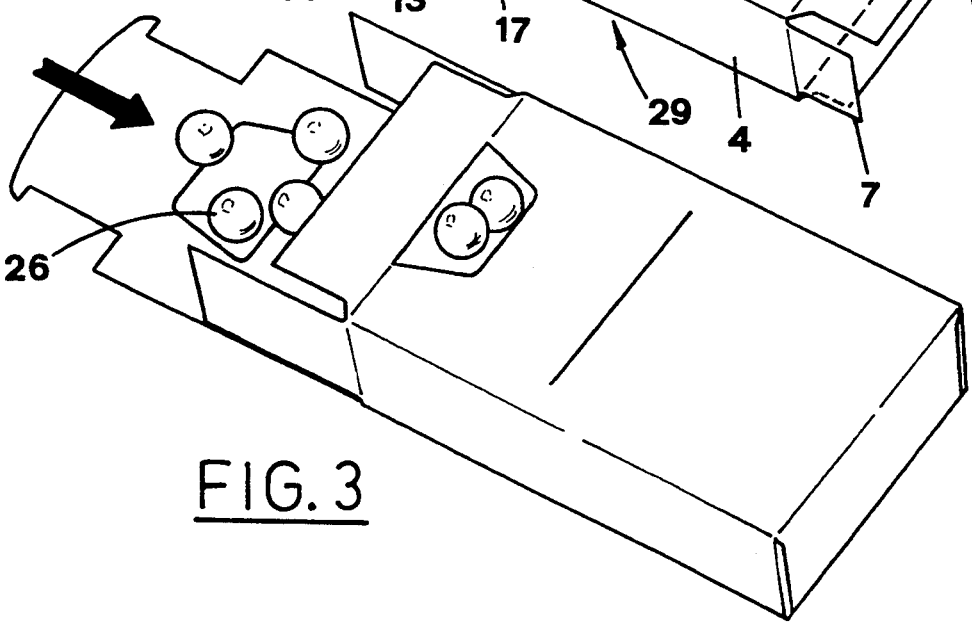
FIG. 3

BOX WITH A SEALED CLOSURE AND WITH A RECLOSABLE PRODUCT DELIVERY SPOUT

BACKGROUND OF THE INVENTION

The present invention relates to a box with a sealed closure guaranteeing the product contained therein, and with a reclosable delivery spout.

DESCRIPTION OF THE PRIOR ART

At present, as there is described in the IT-B-1.093.123 and GB-B-1.559.824, a box with a sealed closure guaranteeing the product contained therein, and a reclosable product delivery spout, includes a front wall with a product delivery spout and a sliding plate located inside the box and designed to reveal or to cover the product delivery spout.

The sliding plate features small lateral flaps, which when the plate slides, in a first case they slide inside grooves made in the lateral walls of the box body, while in a second case they slide onto the inner surfaces of the said lateral walls. In both cases the sliding stroke of the sliding plate is so limited as to define the closing position and the opening position for the product delivery spout for, respectively, keeping or delivering the products.

Moreover, in order to provide a guarantee seal for the box, there is a member fixed to the box body along perforated lines, which member has the task of preventing the sliding plate from shifting. The blocking member will then be torn away by the user along the perforated lines, so as to allow the sliding plate to shift from the spout covering position to the spout revealing position, and vice-versa.

Adoption of the above-mentioned box, however, leads to problems, namely problems in its erection, problems in its loading and in its use.

The problems which are encoutered in the box erection stage, are basically due to the fact that an unfolded flat blank is used, that must completely be erected by folding and gluing its fold portions, which requires complex operations to be performed by the erecting machine.

Another problem that arises in the erecting stage occurs while folding the sliding plate towards the inside of the box, which must be a very precise operation since the guiding flaps of the sliding plate have to insert into the corresponding grooves made in the lateral walls, or have to perfectly adhere to the same lateral walls. Furthermore, while gluing the lateral walls a great deal of attention must be brought to the fact that glue particles do not come in contact with the sliding plate guiding flaps, so as to avoid that the same guiding flaps be sticked to the box body thus preventing them from correctly sliding thereafter.

The problems encountered while loading the box with the products, are due to the fact that generally the loading takes place together with the box erection, that is before that the erectiong stages has been completed. Therefore, in the subsequent stages, a few products may come out of the box that is not finished yet, and this can provoke a jamming of the packaging machine. For this reason the loading of the box must be slow and limited while the loading space inside the box cannot be fully utilized.

The problems encountered in the use of the box are due to the shape and dimension of the products contained therein, and to the fact that also the sliding plate is located inside the box. If pills are stored in the box, it will be possible that, while the box is transported or subsequently used, some of these pills or particles thereof go between the sliding surfaces which touch each other, or between the guides of the said sliding plate flaps and the lateral walls, thus hindering the same plate in its sliding.

SUMMARY OF THE INVENTION

It is an object of the invention to provide a solution to the above-mentioned problems. As a result it is provided a box with a sealed closure guaranteeing the product contained therein, and with a reclosable product delivery spout, comprising a box-like body provided with a product delivery spout and a sliding plate, this sliding plate being hinged to said box-like body and facing the said spout. The box is characterized by the fact that said sliding plate cooperates with the said spout while being outside the box-like body, and is shiftable towards two configurations: a first configuration, a non-use configuration, wherein the said sliding plate, that is hinged to the box-like body, covers the product delivery spout and defines the guarantee seal; and a second configuration, a in-use configuration, wherein the said sliding plate, or part thereof, in inserted into at least a slit made in the said box-like body thus defining a guide for the sliding of the said sliding plate on the outer surface of the box-like body, through a stroke long enough to cover and reveal the product delivery spout, respectively; the said sliding plate being obtained from the over-extention of a central closing panel and facing the front wall of said box-like body.

Another object of the invention is to provide two configurations for the said box, wherein the first configuration, a non-use configuration, is characterized by the fact that the sliding plate is located fully outside the said box-like body, and fixed thereto by means of a welding or gluing spot set between the said sliding plate and the box-like body; the said second configuration, the in-use configuration, is characterized by the fact that the sliding plate is to be disconnected from the box-like body and a portion thereof is to be inserted into a slit made in the box-like body of the said box.

Yet, another object of the invention is to provide a further embodiment of the said box, this further embodiment being characterized by the fact that in the said first configuration, the non-use configuration, the said sliding plate is located outside the said box-like body with an end thereof inserted in the slit and fastened to said box-like body by wrapping the box; the second configuration, the in-use configuration, is obtained by removing the box wrapping.

A further object of the invention is to provide a sliding plate characterized by the fact that the sliding plate has a anchor-like end portion, so as to prevent, when it is inserted in the slit, the sliding plate to come out thereof, thus defining a stop for the spout opening stroke of the sliding plate; the said sliding plate end portion has also side undercuts which define the stop for the spout closing stroke of the sliding plate.

As a result the above-mentioned problems in the erecting stage, in the loading and in the use of the box, are solved.

The problems arising in the erecting stage, which are due to the use of unfolded flat blanks, are thereby solved because with the box made as explained heretofore it is possible to start from a pre-shaped collapsed sleeve blank, thus reducing the number of erection operations which are required for the complete erection of the box. Furthermore, folding the sliding plate over the outer surface of the box is much easier than folding it towards the inside of the box, and a high precision is not requested, since the sliding plate guiding flaps are not to be inserted into grooves made in the side walls, neither to exactly fold them in order to make them to adhere to the side walls. Also an high precision in the gluing operation is no more requested to avoid sticking between the guiding flaps and the side walls, since the said sliding plate is not set in the box body.

Also the problems encountered in the products loading stage, are overcome because the box body is completely erected before the loading takes place, leaving open the box upper head that is further easily closed by folding the side and central flaps as well as the sliding plate.

Lastly, since the sliding plate is located outside the box body, also the problems due to the products contained in the box, or to particles thereof, going between the sliding surfaces which are in contact with each other, or between the guides for the sliding plate flaps, are avoided, because there are no sliding members inside the box.

As a result, with this box an increasing is achieved in the productivity in the time unit, providing a box with a sealed closure guaranteeing the product contained therein, and with a product delivery spout made free from any jamming.

Further features and advantages of the present invention are set forth in the following detailed description, where a preferred embodiment, only illustrative, is disclosed as an example with reference to the accompanying drawings, in which:

BRIEF DESCRIPTION OF THE DRAWINGS

FIG. 1 is a perspective view of the blank folded and knocked down at the beginning of the erecting stage;

FIG. 2 is a perspective view of the said blank in the final configuration thereof;

FIG. 3 is a perspective view of the same blank with the bottom already closed, while it is loaded;

DESCRIPTION OF THE PREFERRED EMBODIMENTS

Figure 6:
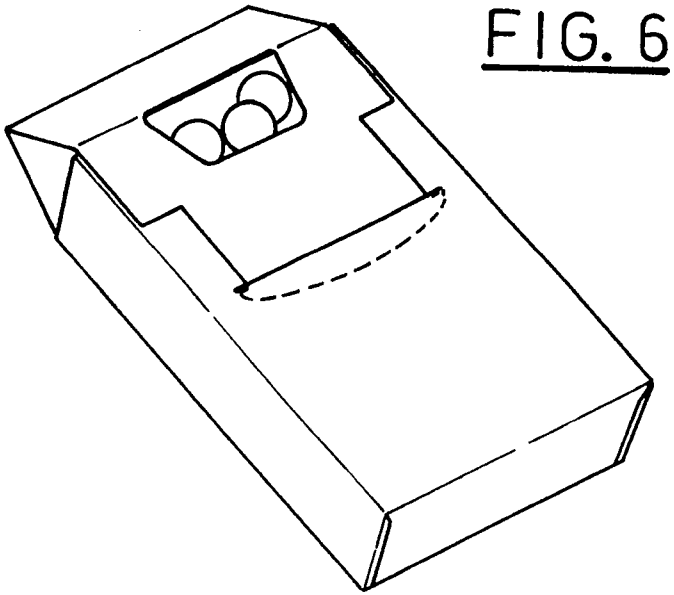
FIG. 6 is a perspective view of the box in a second in-use configuration with the delivery spout opened.
Figure 5:
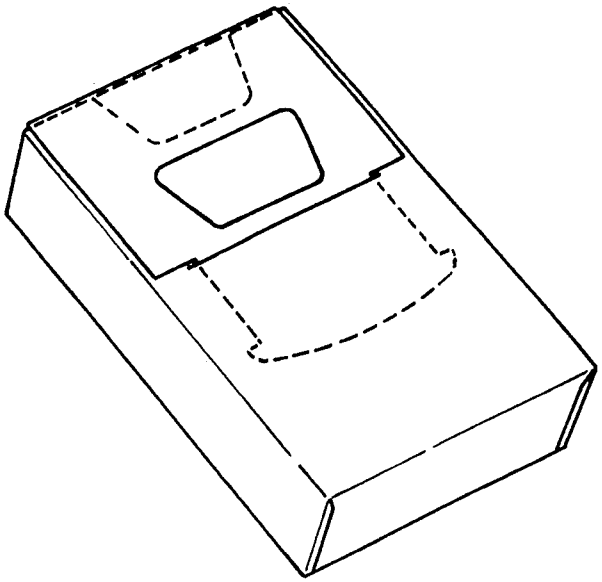
FIG. 5 is a perspective view of the box in a second in-use configuration with the delivery spout closed.

Referring to the above figures, reference numeral 1 indicates a flattened collapsed blank that comprises a box-like body 29 constituted by the front wall 2, by the side walls 3 e 4, and by the rear wall 5. The two heads of said box-like comprise, as it is well known, at the right part, or at the bottom, a pair of lateral closing flaps 6 and 7 and the pair of central upper and lower closing flaps 8 and 9, while at the left part, or at the top, there are a pair of lateral closing flaps 10 and 11, the upper central closing flap 12 and, delimited by fold lines 13 and 14, the lower central closing flap 15. A further flap extends from the lower central closing flap 15, beyond the fold line 14, to define the sliding plate 16.

The front wall 2 has in its upper part an opening that leads to the inside of the box, thus defining the delivery spout. The front wall has also a slit 18.

Figure 4:
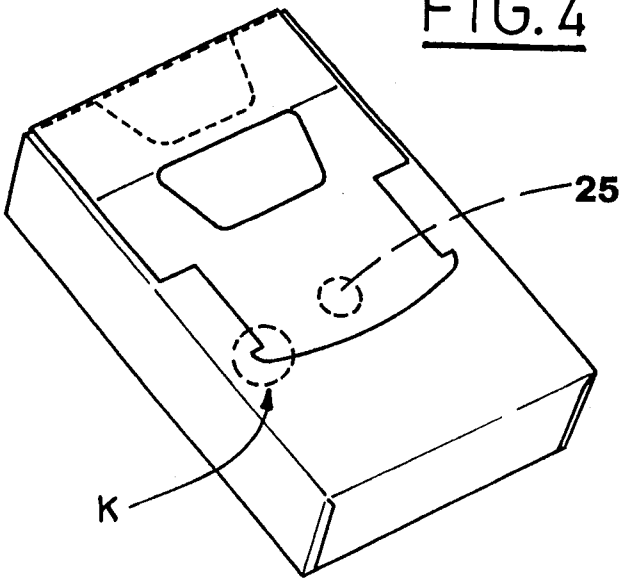
FIG. 4 is a perspective view of the completed box in the first configuration, ready to be sold.
Figure 4A:
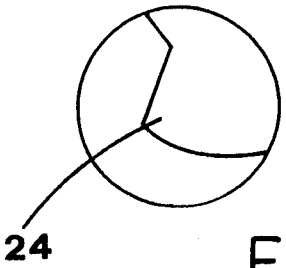
FIG. 4*a* is an enlarged view of particular K of FIG. 4.

The sliding plate 16 features an opening 19 and is shaped so as to get at once narrower near the free and, by means of undercuts 20,21. Then at the free end the slide plate 16 projects outwards with projections 23 and 24 which are preferably shaped according to the particular K shown in FIG. 4*a*.

The erecting stage is very much simplified; first the blank 1 is unfolded to the squared shape, as it is shown in FIG. 2. Then the bottom side flaps 6,7 and central flaps 8,9 are folded and welded or glued, so as to define in this way the box-like body 29 that is afterwords filled with corresponding products 26 through the left or upper head, as it is shown in FIG. 3.

Upon completition of the filling, the central flap 12 is folded, then the side flaps 10 e 11 are folded and glued to the central flap 12. Lastly the central flap 15 is folded while placing the sliding plate 16 upon the frontal wall 2 and fastening it thereto by means of a small welding (or gluing) 25, that may be easily detached, see in detail in FIG. 4.

In this first configuration the box is completely closed, and the products contained therein are prevented from going out of the box because the opening 19, made in the sliding plate 16, does not correspond with the opening 17 made in the front wall 2.

This configuration, indicated as first configuration, suits very well the box during the sale, because the product is prevented from going out since the plate 16 covers the spout 17 made in the wall 2, while the welding 25 provides for a tamperproof sealed closure that guarantees the product contained in the box.

The user, in order to use the box, must detach the welding 25, and then insert the anchor-like end portion 22 of the sliding plate 16 in the slit 18, that is slightly shorter than the width of the anchor-like end portion 22. Like this, once that the anchor-like end portion 22 has been inserted in the slit 18, the projections 23 and 24 prevent it from coming out.

The said second configuration is indicated as in-use configuration, and includes two extemity positions. In a first closing position, that is shown in FIG. 6, the plate 16 is completely inserted in the slit 18 so that the delivery spout 17 is covered by the said plate 16, thus preventing the products from going out, while in a second position, that is shown in FIG. 6, the plate 16 has been taken out of the slit by making it to slide until the projections 23 and 24 strike against the edges of the slit 18. In this position the opening 19 of the sliding plate 16 fully corresponds to the spout 17 made in the frontal wall 2, thus allowing the products to be delivered.

Once that a desired amount of products have been withdrawn from the box, the plate 16 is moved back to the first closing position thus preventing further products from going out.

Figure 8:
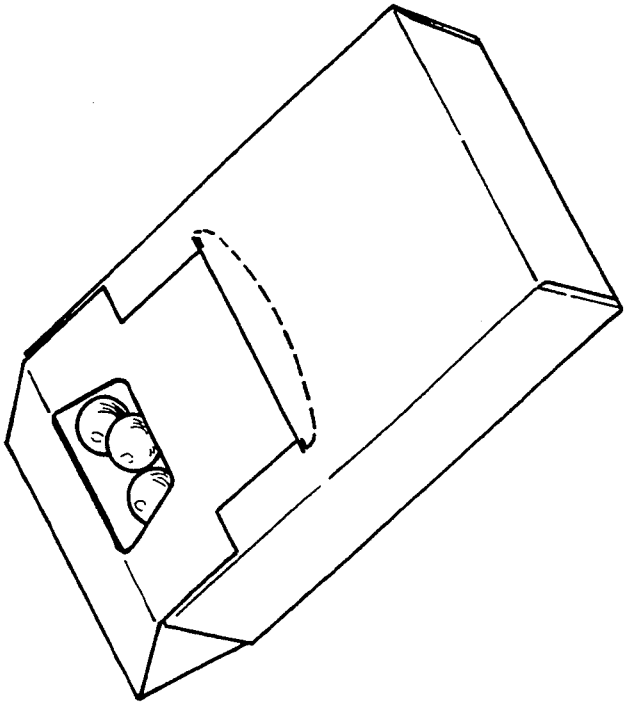
FIG. 8 is a perspective view of the box of FIG. 7 according to the second in-use configuration with the delivery spout opened.
Figure 7:
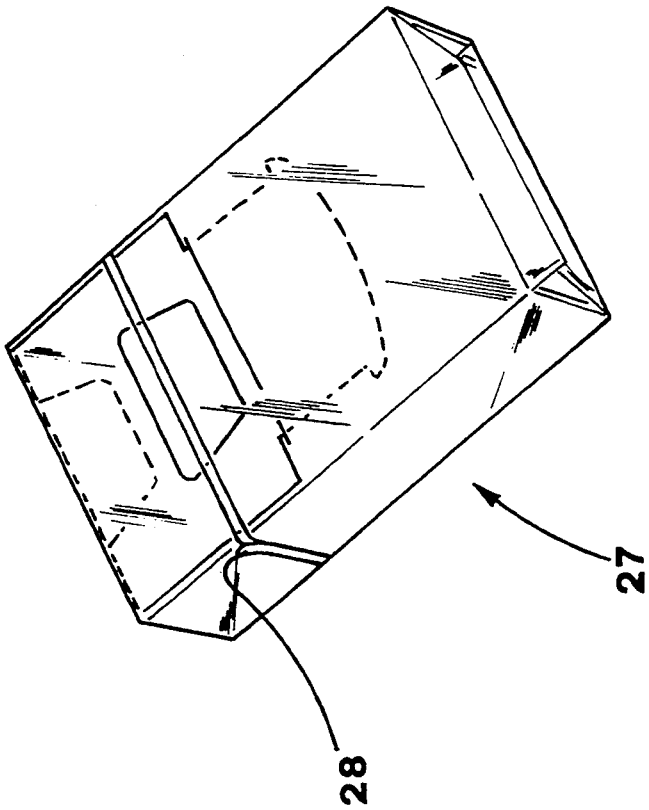
FIG. 7 is a perspective view of the box in the first configuration, according to a further embodiment, ready to be sold.

According to a further embodiment, that is shown in FIGS. 7 and 8, after that the box has been filled, the central flap 12 is folded. Then also the side flaps 10 and 11 are folded and glued to the central flap 12. Lastly the central flap 15 is folded and the sliding plate 16 is placed over the frontal wall 2 without fixing it thereto, while the end portion 22 is inserted in the slit 18. The box obtained in this way is then wrapped with wrapping packaging material 27, e.g. cellophane, (see FIG. 7) thus constraining the plate 16 in its position over the wall 2 while the end portion 22 is inserted in the slit 18. Like this the first configuration, i.e. the non-use configuration, is obtained, this configuration being suitable for the box sale handling.

In this first configuration, the products are prevented from going out of the box because the plate 16 covers the spout 17 made in the wall 2, while the wrapping 26 serves as a sealed closure that guarantees about the inviolability of the products.

The user, in order to use the box made in accordance with this further embodiment, must first remove the wrapping 27 by tearing the tear-strip 28. This frees the plate 16 so that the second configuration, i.e. the in-use configuration, can be obtained, this configuration being similar to the one already described for the first embodiment.

Both the embodiments of the box made in accordance with the present invention requires the products 26 delivery spout 17 to be located in the front wall 2 of the box-like body, and the sliding plate 16 made in the over-extension of the lower central flap 15. However, depending on the kind of box that is desired or on the kind of product 26 to be stored therein and further delivered, the delivery spout 17 can be located in any position in the box-like body 29, such as, for instance, in the side walls 3 or 4, or in the rear wall 5. In this case the plate 16 would be made by over-extending one of the bottom closing flaps 6,7,8,9 or top closing flaps 10,11,12,15. Also the slit can be made in any part of the box-like body 29.

The description of the box and of the further embodiment thereof, made with reference to the accompanying drawings, is to be intended as example only, which has no limiting effect, and it is therefore understood that other variations or modifications suggested by putting into practice the invention or using it, may be brought to the embodiments described heretofore falling anyway within the scope of the following claims.

What is claimed is:

1. In a box having a sealed closure guaranteeing the product contained therein, and having a reclosable product delivery spout, said box comprising a box-like body with a product delivery spout, a sliding plate hinged to said box-like body so tat said plate faces said spout, the sliding plate having an opening which covers or reveals said spout, said plate cooperates with the spout outside said box-like body and is shiftable towards two prefixed configurations, a first non-use configuration wherein said plate hinged to said box-like body covers said product delivery spout to define a sealed closure guaranteeing the product contained in the box, and a second in-use configuration wherein said plate, or a part thereof, is inserted into a slit made in said box-like body to define a guide for the sliding of the said plate upon the outer surface of the box-like body along a stroke so limited as to cover or to reveal the product delivery spout, and thus to bring said opening into or out of correspondence with the product delivery spout.

2. A box as claimed in claim 1, wherein said plate in said first configuration is located fully outside said box-like body and is fastened thereto by means of a welding or gluing spot set between said plate and the box-like body.

3. A box as claimed in claim 2, wherein said welding spot is set between sad plate and a front wall of said box-like body.

4. A box as claimed in claim 1, wherein said plate is obtained by over-extending a central closing flap and faces the front wall of said box-like body.

5. A box as claimed in claim 4, wherein said plate in said first configuration is located fully outside said box-like body and is fastened thereto by means of a welding or gluing spot set between said plate and the box-like body.

6. A box as claimed in claim 5, wherein said welding spot is set between said plate and the front wall of said box-like body.

7. A box as claimed in claim 1, wherein said second in-use configuration, includes detaching the plate from the box-like body and inserting an end portion of said plate into the slit made in the box-like body.

8. A box as claimed in claim 1, wherein said plate in said first configuration is located fully outside said box-like body with an end portion of said plate inserted into the slit, said plate being kept attached to said box-like body by a wrap placed around the box.

9. A box as claimed in claim 8, wherein said second in-use configuration, includes having the wrap of the box removed.

10. A box as claimed in claim 4, wherein said plate in said first configuration is located fully outside said box-like body with an end portion of said plate inserted into said slit, said plate being kept attached to said box-like body by a wrapped placed around the box.

11. A box as claimed in claim 9, wherein said second configuration, that is the in-use configuration, includes having the wrap of the box removed.

12. A box as claimed in claim 1, wherein said plate has an end portion that is shaped like an anchor so that when said end portion is inserted into said slit it is prevented from going out thereof, thus defining a stop for the spout opening stroke of said plate.

13. A box as claimed in claim 1, wherein said plate has an end portion that having undercuts aimed at defining a stop for the spout closing stroke of said plate.

* * * * *